US006379877B1

(12) United States Patent
Henderickx et al.

(10) Patent No.: US 6,379,877 B1
(45) Date of Patent: Apr. 30, 2002

(54) METHOD FOR DEVELOPING AN EXPOSED PHOTOGRAPHIC SILVER HALIDE MATERIAL

(75) Inventors: Freddy Henderickx, Olen; Ann Verbeeck, Begijnendijk; Pascal Meeus, Turnhout; Hieronymus Andriessen, Beerse, all of (BE)

(73) Assignee: Agfa-Gevaert, Mortsel ( * ) Notice: Subject to any disclaimer, the term of this patent is extended or adjusted under 35 U.S.C. 154(b) by 1005 days.

(21) Appl. No.: 08/594,721

(22) Filed: Jan. 31, 1996

(30) Foreign Application Priority Data

Feb. 21, 1995 (EP) ..... 95200419

(51) Int. Cl.[7] ..... G03C 5/30

(52) U.S. Cl. ..... 430/478; 430/480; 430/481; 430/483

(58) Field of Search ..... 430/464, 478, 430/480, 481, 483, 486

(56) References Cited

U.S. PATENT DOCUMENTS

| | | | | | |
|---|---|---|---|---|---|
| 3,512,981 | A | | 5/1970 | Prchal et al. | 430/265 |
| 3,799,780 | A | | 3/1974 | Suga | 430/265 |
| 3,865,591 | A | | 2/1975 | Katz | 430/437 |
| 3,867,151 | A | | 2/1975 | Katz | 430/419 |
| 4,322,493 | A | | 3/1982 | Shibaoka et al. | 430/407 |
| 5,098,819 | A | * | 3/1992 | Knapp | 430/480 |
| 5,126,227 | A | * | 6/1992 | Machonkin et al. | 430/611 |
| 5,264,323 | A | * | 11/1993 | Purol et al. | 430/480 |
| 5,397,687 | A | | 3/1995 | Willems et al. | 43/502 |
| 5,445,927 | A | * | 8/1995 | Florens et al. | 430/502 |
| 5,474,879 | A | * | 12/1995 | Fitterman et al. | 430/480 |

FOREIGN PATENT DOCUMENTS

| | | |
|---|---|---|
| DE | 182670 | 7/1905 |
| EP | 0 552 511 A1 | 7/1993 |
| WO | WO 93/12463 | 6/1993 |
| WO | WO 95/00881 | 1/1995 |

* cited by examiner

*Primary Examiner*—Hoa Van Le
(74) *Attorney, Agent, or Firm*—Breiner & Breiner, L.L.C.

(57) ABSTRACT

According to this invention a developer has been disclosed having a low pH value between 9.6 and 11.0, preferably between 9.6 and 10.3, and comprising hydroquinone in an amount from 0 to less than 30 g per liter, an auxiliary developing agent, and as silver halide complexing agents alkali metal sulphite salts, preferably sodium salts, in an amount from 0 to less than 50 g per liter, more preferably to less than 40 g per liter, and thiocyanate salts in amounts from 0.1 to 3 g, more preferably from 0.5 to 2.5 g per liter, and at least 1 g of a compound corresponding to the formula (I), a precursor thereof, a derivative thereof and/or a metal salt thereof (I)

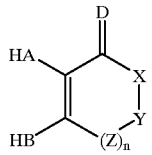

wherein each of A, B and D independently represents an oxygen atom or $NR^1$;

X represents an oxygen atom, a sulphur atom, $NR^2$; $CR^3R^4$; C=O; $C{=}NR^5$ or C=S;

Y represents an oxygen atom, a sulphur atom, $NR'^2$; $CR'^3R'^4$; C=O; $C{=}NR'^5$ or C=S;

Z represents an oxygen atom, a sulphur atom, $NR''^2$; $CR''^3R''^4$; C=O; $C{=}NR''^5$ or C=S;

n equals 0, 1 or 2;

each of $R^1$ to $R^5$, $R'^1$ to $R'^5$ and $R''^1$ to $R''^5$, independently represents hydrogen, subsituted or unsubstituted alkyl, aralkyl, hydroxyalkyl, carboxyalkyl; substituted or unsubstituted alkenyl, substituted or unsubstituted alkynyl, substituted or unsubstituted cycloalkyl, substituted or unsubstituted cycloalkenyl, substituted or unsubstituted aryl or substituted or unsubstituted heterocyclyl; and wherein $R^3$ and $R^4$, $R'^3$ and $R'^4$, $R''^3$ and $R''^4$, may further form together a ring; and wherein in the case that $X{=}CR^3R^4$ and $Y{=}CR'^3R'^4$, $R^3$ and $R'^3$ and/or $R^4$ and $R'^4$ may form a ring and wherein in the case that $Y{=}CR'^3R'^4$ and $Z{=}CR''^3R''^4$ with n=1 or 2, $R'^3$ and $R''^3$ and/or $R'^4$ and $R''^4$ may form a ring.

15 Claims, No Drawings

METHOD FOR DEVELOPING AN EXPOSED PHOTOGRAPHIC SILVER HALIDE MATERIAL

1. FIELD OF THE INVENTION

The present invention relates to a developing solution and a method for developing an exposed photographic silver halide material.

2. BACKGROUND OF THE INVENTION

It is known that by processing a silver halide photographic material finely divided metallic silver, so-called silver deposit, is formed in the developer (ref. e.g. Photographic Silver Halide Diffusion Processes by A. Rott and E. Weyde—The Focal Press, (1972), p. 67). The formation of silver deposit is particularly disturbing in automatic processing apparatus wherein it results in deposits of black silver on conveyor and transport rollers and smudging of photographic material conducted therewith.

The formation of silver deposit can be attributed to the presence in conventional developers of silver halide complexing agents like, e.g., sulphite and thiocyanate ions, which are present for stability and speed. In this medium the complex ions formed are effectively reduced to metallic silver nuclei. Growth of said nearly invisible fine nuclei leads to the formation of said silver deposit. As a consequence regularly cleaning of the automatic processing machines is required. When a film is introduced into the processor as first film of a whole series of films, its first contact with the first stained roller releases the deposit from the said roller or disturbs the deposited layer. As a consequence after one rotation of the said roller the unevenly distributed dirt or stain comes into contact again with the transported film surface so that it may be deposited onto said surface. This phenomenon is recurrently repeated, not only at the first roller, but also at the further rollers that are mounted onto the racks and is well-known as "pi-line" defect. The crystalline silver deposit may further cause damaging of the surface of the coated hydrophilic layers on the film and/or cause locally situated pressure phenomena, resulting in "artefacts", thereby seriously impeding the diagnostic value of the obtained image. Especially when the silver halide photographic material shows processed images with a diagnostic value, like, e.g., in medical imaging or in non-destructive testing, said diagnostic value may be impaired.

Besides the occurrence of this defect in processed materials for radiographic recording and duplicating, it can also be detected at films and papers for general amateur and professional photography, at materials for pre-press graphic arts applications, films for cinematographic recording and printing, materials which after processing can serve as planographic printing plates, microfilm applications, etc.

In order to prevent the formation of silver deposit it has been proposed to add particular compounds to the developer, forming sparingly soluble and non-reducible silver salts, as, e.g., 5,5'-bis-1,2,4-triazoline-3-thiones or derivatives of 1,3,4-thiadiazole-2-thiols as described, e.g. in BE-P 606,550 and GB-P 1,120,963, 2-mercapto-1,3,4-thiadiazoles described in U.S. Pat. No. 3,212,892. A great variety of other mercapto compounds has been described in FR-P 1,470,235 and 1-phenyl-5-mercapto-tetrazole compounds having a —NHX substituent on the phenyl nucleus have been disclosed in GB-P 1,471,554. In the latter document it has been described that the emulsion layer may contain auxiliary coating agents such as saponin, sodium lauryl sulphate, dodecylphenol polyethylene oxide ether and hexadecyltrimethyl ammonium bromide.

The same result can be obtained by the presence in the developer of the fog inhibitor 1-phenyl-5-mercaptotetrazole, but if it is used in an amount higher than necessary for reducing fog in the silver halide photographic material, the sensitivity of the said material is markedly reduced. Such effect is probably due to the penetrating of the 1-phenyl-5-mercaptotetrazole from the developer liquid into the exposed photographic silver halide emulsion layer and its interaction with latent image nuclei. More recently triazolium thiolates for use in the developer have been described in e.g. EP-A 0 533 182.

In EP-Specification 0 223 883 a method to reduce the appearance of silver deposit has been described which comprises the treating of a silver halide photographic material with an aqueous alkaline liquid in the presence of (i) a developing agent, (ii) a heterocyclic mercapto compound including an aliphatic group of at least 3 carbon atoms and (iii) a surface active agent, characterised in that said surface active agent is an anionic alkylphenoxy polyalkyleneoxy phosphate ester surfactant.

In EP-A 0 620 484, reduction of the so-called "pi-line" defect, already mentioned hereinbefore, especially for processed materials for non-destructive testing purposes, has been described. Such materials should comprise at least one vinyl sulphone compound as a hardening agent and at least one polyoxyalkylene compound as a surfactant in at least one of its hydrophilic layers. Combined with a processing method comprising a developing step wherein the developer comprises as a surfactant at least one anionic alkylphenoxy and/or alkoxy polyalkyleneoxy phosphate ester, sulphate ester, alkyl carboxylic, sulphonic or phosphonic acid and/or a salt thereof a remarkable improvement has been obtained. A similar result has been obtained as disclosed in EP-A's 0 621 506 and 0 620 483.

Although said methods to reduce the amount of silver deposit are very effective it is not more than a "treating method" wherein the amount of silver nuclei is not decreased but wherein said nuclei are more "dispersed" and are merely inhibited to grow further to form larger crystalline silver deposits. No "curing" effect in the sense of reducing the generation of nuclei can be obtained with these methods. Moreover the stability of the developer, especially its sensitivity to oxidation by contact with air oxygen, is not improved either.

3. OBJECTS OF THE INVENTION

It is an object of the present invention to provide a stable developer and a method for developing a photographic silver halide material wherein the formation of silver deposit is reduced effectively without adversely affecting photographic speed.

It is a further object of the present invention to provide a suitable sensitometry for the material processed in the developer used according to the method of this invention.

Moreover it is an object to provide a developing method, wherein the developer is stable against oxidation by air oxygen as a low regeneration volume per square unit of the said material should be highly appreciated.

Other objects and advantages of the present invention will become clear from the further description.

4. SUMMARY OF THE INVENTION

It has surprisingly been found now that the objects of the invention can be attained by providing a developer having a low pH value between 9.6 and 11.0, preferably between 9.6 and 10.3, and comprising hydroquinone in an amount from 0 to less than 30 g per liter, an auxiliary developing agent, and as silver halide complexing agents alkali metal sulphite salts, preferably sodium salts, in an amount from 0 to less than 50 g per liter, more preferably to less than 40 g per liter, and thiocyanate salts in amounts from 0.1 to 3 g, more preferably from 0.5 to 2.5 g per liter, and at least 1 g per liter of a compound corresponding to the formula (I), a precursor thereof, a derivative thereof and/or a metal salt thereof (I)

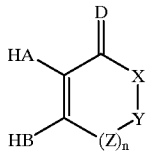

wherein each of A, B and D independently represents an oxygen atom or $NR^1$;

X represents an oxygen atom, a sulphur atom, $NR^2$; $CR^3R^4$; C═O; $C{=}NR^5$ or C═S;

Y represents an oxygen atom, a sulphur atom, $NR'^2$; $CR'^3R'^4$; C═O; $C{=}NR'^5$ or C═S;

Z represents an oxygen atom, a sulphur atom, $NR''^2$; $CR''^3R''^4$; C═O; $C{=}NR''^5$ or C═S;

n equals 0, 1 or 2;

each of $R^1$ to $R^5$, $R'^1$ to $R'^5$ and $R''^1$ to $R''^5$, independently represents hydrogen, subsituted or unsubstituted alkyl, aralkyl, hydroxyalkyl, carboxyalkyl; substituted or unsubstituted alkenyl, substituted or unsubstituted alkynyl, substituted or unsubstituted cycloalkyl, substituted or unsubstituted cycloalkenyl, substituted or unsubstituted aryl or substituted or unsubstituted heterocyclyl; and wherein $R^3$ and $R^4$, $R'^3$ and $R'^4$, $R''^3$ and $R''^4$, may further form together a ring; and wherein in the case that $X{=}CR^3R^4$ and $Y{=}CR'^3R'^4$, $R^3$ and $R'^3$ and/or $R^4$ and $R'^4$ may form a ring and wherein in the case that $Y{=}CR'^3R'^4$ and $Z{=}CR''^3R''^4$ with n=1 or 2, $R'^3$ and $R''^3$ and/or $R'^4$ and $R''^4$ may form a ring.

5. DETAILED DESCRIPTION OF THE INVENTION

It has unexpectedly been found that a solution of the problem of silver deposit and stability of a developer containing developing agents and lower amounts of silver complexing compounds like alkali metal sulphite salts, is offered by the addition to the said developer of potassium thiocyanate in an amount from 0.1 to 3 grams and of at least 1 g of a compound corresponding to the formula (I) given above, a precursor thereof, a derivative thereof and/or a metal salt thereof.

In a preferred embodiment in the formula (I) A, B and X each represent an oxygen atom; n=0; $Y{=}CH{-}(CHOH)_m{-}CH_2{-}R^6$ wherein m=1,2,3 or 4 and wherein $R^6$ represents OH for m=1; H or OH for m=2,3 or 4. This formula corresponds with (iso)ascorbic acid. As a suitable derivative corresponding to the formula (I), iso-ascorbic acid and 1-ascorbic acid are both preferred.

In another preferred embodiment A and B each represent an oxygen atom; n=0 and X and Y each correspond with $C(CH_3)_2$. This formula corresponds with tetramethyl reductic acid.

The compound(s) according to the formula (I) preferably is(are) present in the developer solution in an amount comprised between 1 g and 50 g per liter. Examples of reducing precursor compounds have, e.g., been described in WO's 94/3834 and 94/16362, which are both incorporated herein by reference.

It is clear that within the context of this invention ascorbic acid is not merely used in the developer as an antioxidant as, e.g., described in WO 93/12463, in JP-A's 4428673 and 55149936, in GB 1,266,533 and in U.S. Pat. Nos. 3,865,591; 4,756,997 and 4,839,259 and in the literature as, e.g., J. Am. Chem. Soc., 60 (1938), p. 99 and p. 2084; 61 (1939), p. 442; 64 (1942), p. 1561, 65 (1943), p. 1489; 66 (1944), p. 700 and 104 (1982), p. 6273.

An essential feature in accordance with this invention is the presence in the developer of an additional amount of at least 0.1 g to 3 g per liter of potassium thiocyanate as a silver complexing agent. An equivalent amount of a thiocyanate salt, having a cation different from potassium may be added.

The developer liquid may contain any combination of hydroquinone as a developing agent and auxiliary developing agent known for use in the development of exposed photographic silver halide. If hydroquinone is absent the said auxiliary developing agent may still be present. For example as auxiliary developing compounds may be utilized p-methylaminophenol, a 1-phenyl-3-pyrazolidine-1-one, p-phenylenediamine derivatives and the like. Amounts of hydroquinone from 0 to less than 30 g per liter can be present and more preferred lower than 20 g per liter. Preferred amounts of auxiliary developer are present in a concentration range of 0 up to 10 mmoles per liter of developer, said auxiliary developer being preferably a 1-phenyl-3-pyrazolidine-1-one compound.

The developer further comprises silver complexing compound(s) such as alkali metal sulphites, bisulphites, metasulphites or metabisulphites. Preferably it contains an alkali metal sulphite salt, and more preferably sodium sulphite, in an amount from 0 to 50, and more preferably in an amount from 0 to 40 g per liter of developer, which is substantially lower than amounts set forth, e.g., in EP 0 538 947, wherein developer compositions have been described for use in the processing of non-destructive testing materials. The developer solution can be alkalised with alkaline metal hydroxides, phosphates, borates, carbonates and the like. The developer liquid or activator liquid may contain still other ingredients, e.g. metal complexing agents, an anti-fogging agent, e.g. alkali metal bromide, in amounts ranging from 0.01 to 0.4 moles per liter, a benzotriazole, a benzothiazole, a tetrazole, e.g., up to 0.06 g per liter of 1-phenyl-5-mercapto-tetrazole, solvents improving the dissolution of the developing agents, e.g., alcohols, polyethylene glycols and esters thereof and alkanolamines, surface active agents, development retarding or activating compounds, e.g., quaternary ammonium salts, and gelatin hardening agents, e.g., dialdehyde compounds such as glutardialdehyde. Especially the presence of polyethylene glycols having a low molecular weight in the range from 200 to 400 is preferred.

It is further clear the developer according to this invention does not contain thiosulphate ions as is the case, e.g., for monobath compositions having a combined developing and fixation action as is demonstrated, e.g., in U.S. Pat. No. 3,867,151.

Important to note is the pH of the developer solution according to this invention, which is in the range of 9.6 to 11.0, and more preferably in the range of 9.6 to 10.3.

It is remarkable that at those relatively low pH values, if compared with more frequently used alkaline pH values of 12.0 and more, the required sensitometry is still attained, which means that a developer having a composition according to this invention offers enough reactivity to get the required sensitivity for a material that is processed therein within a reasonable processing time.

The present invention thus includes a method for developing, by means of the developer according to this invention, any type of photographic silver halide emulsion layer material, e.g., a graphic art, a micrographic or an X-ray recording material, after image-wise exposing the said material by means of suitable radiation sources, adapted to each application in particular, and immersing it into the said developer.

The development process according to the present invention is advantageously applied in automatic processing equipment, preferably one containing conveyer rollers as described, e.g., in U.S. Pat. Nos. 3,025,779 and 3,545,971, in a time between 5 and 45 seconds at a temperature between 25 and 40° C.

Preferably the concentration of the compounds corresponding to the formula (I) and the pH is maintained at a constant value by replenishment with unoxidised developing agent, thereby adding a concentrated alkali hydroxide solution under controlled constant redox potential as has been illustrated in EP-A 0 552 511, which is incorporated herein by reference. This invention allows the use of low regeneration amounts of the developer, having a composition as described hereinbefore: low regeneration amounts of developing solution from 50 to 250 ml/m$^2$ of photographic material are possible and even more preferred from 50 to 150 ml/m$^2$.

silver halide emulsions incorporated in at least one photosensitive layer in a suitable layer arrangement of the said materials which can be processed in a developer according to this invention are composed of silver bromide, silver bromoiodide, silver chloride, silver chlorobromide, silver chloroiodide and silver chlorobromoiodide.

Photosensitive silver halide emulsion layer(s) present in silver halide photographic materials used in the method according to this invention may be of any type or composition used in silver halide photography and may be present in whatever a layer arrangement used in the art of photography.

So black-and-white silver halide films intended to be used for contact exposures form an important class of photographic films. These so-called contact films are used for proper reproduction on one hand and for dry dot-etching on the other hand. In modern pre-press graphic arts these contact materials are designed to be usable for several minutes under roomlight conditions, meaning light containing substantially no UV-light. Accurately reproducing the relative proportions of white and black areas of a dot or line image implicates high contrast and high image density. Contact materials usually are processed in Rapid Access chemistry containing hydroquinone, but they give equal or better results, concerning contrast or image density, in Rapid Access chemistry containing ascorbic acid or ascorbic acid derivatives instead of hydroquinone.

The present invention is illustrated by the following example without, however, limiting it thereto.

6. EXAMPLES

Methods to determine quantitatively the silver deposit present in developing solutions used in the processing of silver halide photographic materials have ever been difficult to be carried out unambigeously. Many factors are indeed playing a role in the phenomenon related to silver deposit:

a. with relation to the film material, the determining factors can be summarised as: the ratio of the exposed to the unexposed surface part of the film (as this ratio is determining the chemical and physical dissolution reactions); water absorption (determined by the degree of hardening of the material); grain size of the emulsions (determining the solubility of the said grains); type of gelatin used in the coated layers; stabilising compounds (determining silver complexation and adsorption in the rinsing step of the processing) and spectral sensitisation (also related with adsorption).

b. with relation to the developer: the sort and the amounts of compounds promoting the solubility of silver ions, the pH value having an influence on complexation, the total volume of the developer in the processing machine and the regeneration volume.

c. with relation to the processing, the agitation and squeezing throughout the rollers, the temperature, the developing time, the simultaneous use of different types of films and the cross-over. Two methods have been worked out.

Method A

Method A makes use of the GEVASET 437N automatic processor, trademarked product for Agfa-Gevaert, which has a tank volume of only 1 liter per tank. The temperature and the processing velocity are made variable. As there is only one roller before entering and after leaving every bath, there is no danger to disturb the outlook of the film surface. Moreover the agitation of the developer is reduced to a negligable extent and the developer tank is followed by two fixation tanks and one rinsing tank, both having a content of 1 liter. At a velocity of 25 cm/min, the film is immersed into the developer tank for 46 seconds at a temperature of 30° C. The developer is not regenerated.

In the exhaustion experiment, according to the "method A" 15 sheets of film, together being equal to a total surface of 1 m$^2$, were processed: 10 sheets were unexposed and 5 sheets of film were completely exposed during 10 minutes in roomlight. The sheets were processed consecutively in the following order: two unexposed films, one exposed film etc.

After exhaustion 1 l of developer was taken from the developer in order to avoid deposit of silver on the walls of the developer tank. A sample thereof was taken to determine the amount of silver present by means of the atomic absorption spectrophotometric (A.A.S.) technique. The beaker was covered with a foil of cellofane and the content was filtered after 24 hours of sedimentation. During said 24 hours the silver deposit has the occasion to grow by agglomeration. The filtration was carried out under vacuum suction with a Büchner filter apparatus with a filtration paper Rotband Nr 589-5, the weight of which was determined before the operation started. After filtration the filter was rinsed with about 1 l of demineralised water, in order to remove the soluble salts of the developer. The filter paper was dried in an oven for 1 hour at 80° C., whereafter it was cooled for 90 minutes and weighed again. The difference in weight obtained gives an idea about the amount of silver deposit. After 4 weeks the procedure was repeated in order to detect the velocity of sedimentation. From the resulting filtrate a sample was taken to determine the amount of silver therein by means of A.A.S.

Experimental data are further given in Example 1.

Method B

In a COPYPROOF 38, trademarked product from Agfa-Gevaert, 4 small developing tanks, each having a content of 150 ml, were built in. The temperature was held constant at a value of 35° C. In each tank an unexposed film having a length of 3 meters and a width of 48 mm was developed. The film was immersed in each tank and transported into the direction of the bottom. As the velocity of the film is 13 minutes per 3 meters, the immersion time is about 30 seconds. All experiments were run twice and as a comparative film SPR712p, trademarked product from Aga-Gevaert, was taken and developed in G101, trademarked product from Agfa-Gevaert. Said film in the G101 developer has a silver deposit of ca. 15 ppm (see further in Example 2). After the development was ended, 50 ml of developer was diluted with 50 ml of a stabilising solution (800 ppm of GAFAC, trademarked product from 3M, and 400 ppm of 1-phenyl-5-mercaptotetrazole). The rest of the developer was covered with a foil of cellophane in order to control the resulting amount of silver deposit after 24 hours. In the diluted sample the silver concentration was measured again by means of A.A.S.

Exhaustion Materials

As a silver halide photographic material used in order to exhaust the developer solution, STRUCTURIX D4, trademarked product from Agfa-Gevaert for industrial radiography (non-destructive testing), was chosen. This material is double-side coated and contains an amount of ca. 21 g of silver, expressed as the equivalent amount of silver nitrate per square meter. The said material has been chosen in some experiments in order to reduce the amount of film to a minimum.

The following silver halide materials A and B were prepared in order to be coated identically to the STRUCTURIX D4 material as the normally present cubic crystals having 99 mole % of silver bromide and 1 mole % of iodide ions used therein.

Material A

Material A contains a cubic silver chlorobromoiodide emulsion having 97.6 mole % of silver chloride, 2 mole % of silver bromide and 0.4 mole % of silver iodide. This emulsion was prepared at a pH value of 5.0 and a constant pAg value of 7.35. Its grain size was 0.30 μm and its gesi (ratio of the amount, in grams, of gelatin to silver expressed as the equivalent amount of silver nitrate) was 0.5. The said emulsion was optimally sulphur and gold sensitised.

Material B

Material B contains a cubic silver bromide emulsion having 100 mole % of silver bromide. This emulsion was prepared at a constant pAg value of 8.2. Its grain size was 0.33 μm and its gesi was 0.4. The said emulsion was optimally sulphur and gold sensitised.

For each material A and B amounts of gelatin were added before coating in order to get the same total coating amounts of gelatin in the light-sensitive emulsion layer for each "STRUCTURIX D4" material. The pH value before coating was also adjusted to the same value of 5.5.

Material C

For another exhaustion experiment (see example 2) the graphic material SPR712p (trademarked product from Agfa-Gevaert, having an emulsion rich in chloride: 83.6 mole % of chloride, 16 mole % of bromide and 0.4 mole % of iodide) was chosen. This material, called material C, is single-side coated and contains an amount of ca. 7.5 g of silver, expressed as the equivalent amount of silver nitrate per square meter.

Films for Determining the Sensitometry

In order to show that sensitometric results are matching in the different developers according to this invention the following "reference films" were prepared.

Film A

This material has AgBr(I) tabular crystals containing 1 mole % of iodide in its emulsion layers.

It was prepared as described in EP-A 0 577 886 and was coated as follows:

The emulsion was stabilised with 4-hydroxy-6-methyl-1,3,3a,7-tetra-azaindene and after addition of the normal coating additives the solutions were coated simultaneously together with a protective layer containing 1.1 g gelatine per $m^2$ and per side on both sides of a polyethylene terephthalate film support having a thickness of 175 μm. The resulting photographic material contained per side an amount of silver halide corresponding to 3.5 grams of $AgNO_3$ per $m^2$.

Film B

This material has pure cubic AgCl crystals in its emulsion layers. It was prepared in the following way.

A silver chloride emulsion having cubic silver chloride crystals was prepared by the double jet technique. The silver halide composition was 100 mole % of chloride and the average grain size was 0.55 μm. Therefor an amount of 615 ml of demineralised water was used as starting volume in the vessel, containing further 46 g of inert gelatin and 10.3 mmoles of sodium chloride at 60° C. Concentrated solutions of 1 l of $AgNO_3$ and NaCl, 3 N each, were run with the double jet technique at a rate of 20 ml per minute for the silver nitrate solution during 50 minutes and at a rate of 20.83 ml per minute for the sodium chloride solution during 48 minutes. After an additional physical ripening time of 15 minutes at the end of the precipitation the flocculation procedure could begin: pH was adjusted at a value of 3.3 with a 3 molar solution of sulphuric acid and 4.5 g of polystyrene sulphonic acid was added slowly in 2 minutes. The washing procedure was performed in a discontinuous way, adding 3 l of demineralised water, containing up to 8 mmole of sodium chloride pro liter, until pAg was reaching a value of about 7.3. After addition of inert gelatin to a ratio of gelatin to silver nitrate in the emulsion of about 0.35, the emulsion was peptised and was further chemically ripened to an optimal fog-sensitivity relationship at 52° C., pAg having a value of about 6.95.

Chemical ripening agents, besides gold (in an amount of 0.019 mmole) and sulphur (tetramethyl thiodithiocarboxylic acid diamide in an amount of 0.061 mmole), were toluene thiosulphonic acid and iodide ions, both being predigestion agents in amounts of 0.02 and 8.6 mmoles respectively.

A photographic material was prepared having on a subbed polyester base a gelatinous silver halide emulsion of which the silver halide consists for 99.7% of silver chloride having an average grain size of 0.55 μm the preparation of which has been described above.

Before coating said emulsion was spectrally sensitised with two spectral sensitisers, corresponding to the following formulae (see compound II and compound III):

(II)

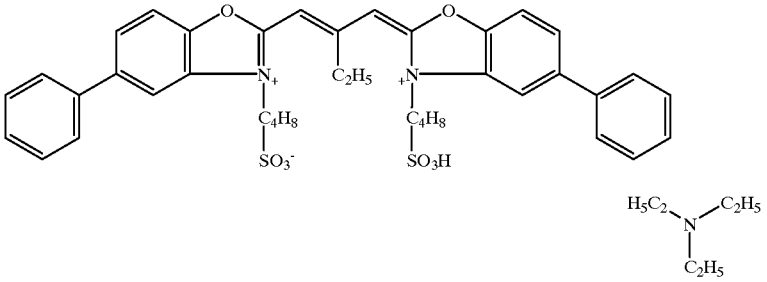

(III)

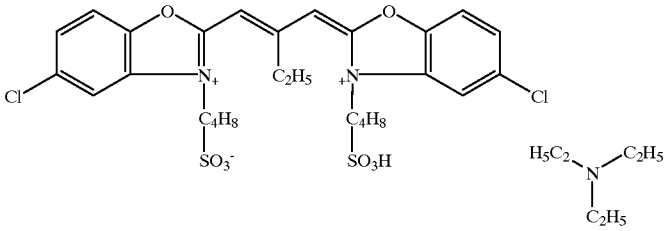

These spectral sensitisers were added consecutively in an amount of 0.1 mmole and 0.3 mmole per mole of silver nitrate respectively. The emulsion was further stabilised with 0.22 mmole of compound (IV) and 0.68 mmole of compound (V) per mole of silver nitrate.

(IV)

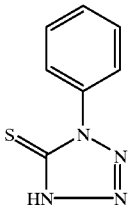

(V)

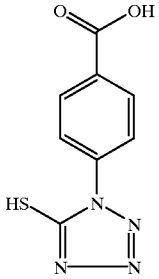

A coated amount of silver expressed as the equivalent amount of silver nitrate of 3.8 g per $m^2$ and a gelatin to silver chloride (expressed in equivalent amount of silver nitrate) ratio of 0.35 was provided with a gelatin covering layer (anti-stress layer) of 1.30 g of gelatin per $m^2$.

The compositions of the developers are given hereinafter.

Amount of compounds making part of the said developers are given in mmoles/liter, unless indicated in another way in the Table.

"Phenidone" represents 1-phenyl-3-pyrazolidine-1-one.

"PMT" represents "1-phenyl-5-mercapto-tetrazole".

"PG400" represents "Polyglycol", having a M.W. (molecular weight) of ca. 400.

Example 1

In Table 1 amounts, in mg/l, of deposited silver determined by means of method A described hereinbefore in Exhausted Developer (ED), after 24 hours (in mg/l) (ED24), after 4 weeks present in the filtrate (mg/l) (ED4W) as well as the Total Deposit (mg/l) (TD) and the rest amount of Deposited Silver in the Filtrate (DSF) are given for material A (rich in AgCl: 97.6 mole %) and for material B (rich in AgBr: 100 mole %), the description of which has been given hereinbefore, in different developers DEV1, DEV2, DEV3 and DEV4 set forth hereinafter.

Compositions of the developers

| Type of dev. | DEV1* | DEV2 | DEV3 | DEV4 | DEV5** | DEV6 | DEV7 |
|---|---|---|---|---|---|---|---|
| pH ready-for-use | 10.1 | 10.5 | 10.0 | 10.0 | 10.5 | 10.0 | 10.0 |
| Hardening | Yes | No | No | No | No | No | No |
| Hydroquinone (mole/l) | 0.27 | 0.18 | 0.18 | 0 | 0.18 | 0.18 | 0.18 |
| Phenidone | 9.3 | 4.6 *** | 4.6 *** | 4.6 *** | 3 | 3 | 3 |
| 5-nitro-indazole | 1.5 | — | — | — | — | — | — |
| PMT | — | — | — | — | 0.17 | 0.17 | 0.17 |
| $Br^-$ | 33.6 | 21 | 21 | 21 | 84 | 84 | 84 |
| 5-methylbenzotriazole | 0.7 | — | — | — | — | — | — |

-continued

| Type of dev. | DEV1* | DEV2 | DEV3 | DEV4 | DEV5** | DEV6 | DEV7 |
|---|---|---|---|---|---|---|---|
| $SO_3^{--}$ (mole/l) | 0.37 | 0.58 | 0.19 | 0.19 | 0.41 | 0.25 | 0.25 |
| $CO_3^{--}$ (mole/l) | 0.23 | 0.22 | 0.44 | 0.44 | 0.17 | 9.27 | 0.27 |
| PG 400 (ml/l) | 0.25 | 20 | 20 | 20 | — | — | — |
| $SCN^-$ | — | 10.3 | 25.7 | 25.7 | — | 5.1 | 5.1 |
| Ascorbic Acid (mole/l) | — | — | 0.11 | 0.28 | — | 0.11 | 0.11 |
| $I^-$ | — | 0.6 | — | — | — | — | — |
| $K^+$ (%) | 100 | 100 | 100 | 100 | 100 | 100 | 0 |
| $Na^+$ (%) | 0 | 0 | 0 | 0 | 0 | 0 | 100 |

*DEV1 is the commercially available developer G138,
**DEV5 is the commercially available developer G101,
DEV1 and DEV5 are both trademark names from Agfa-Gevaert.
***methyl-substituted compound

TABLE 1

| Developer | Material | AgX | ED | ED24 | ED4W | TD | DSF |
|---|---|---|---|---|---|---|---|
| DEV1 (comp.) | A | AgCl | 21.0 | 6.7 | 6.3 | 13.0 | 8.5 |
| | B | AgBr | 9.1 | 6.4 | 0.7 | 7.1 | 1.3 |
| DEV2 (comp.) | A | AgCl | 62.2 | 61.3 | 0.2 | 61.5 | 0.7 |
| | B | AgBr | 11.6 | 1.4 | 3.5 | 4.9 | 4.0 |
| DEV3 (invention) | A | AgCl | 9.8 | 1.0 | 6.7 | 7.7 | 3.2 |
| | B | AgBr | 3.6 | 1.0 | 1.1 | 2.1 | 0.7 |
| DEV4 (invention) | A | AgCl | 13.7 | 9.0 | 0.8 | 9.8 | 3.9 |
| | B | AgBr | 6.6 | 2.9 | 1.2 | 4.1 | 1.6 |

As can be concluded from Table 1 the developers DEV3 and DEV4, according to this invention, provide less silver deposit, for AgCl- as well as for AgBr-emulsions: −60% and −27% resp. for AgBr (vs. DEV1); −84% and −78% resp. for AgCl (vs. DEV2).

In order to show that sensitometric results are matching in the different developers according to this invention and in the "classical developer G138" (=DEV1) the films for determining the sensitometry (Films A and B) were further evaluated in Table 2.

Samples of both coating materials were exposed according to the ANSI procedure 1043. After processing in the developers mentioned in Table 2 for developing times of 22 seconds at 33° C., the sensitometric properties of each material were measured.

Therefor the density was measured as a function of the light dose and therefrom were determined the following parameters:

fog level F (with an accuracy of 0.01 density);

the relative speed S at a density of 1 above fog (expressed in logarithmic terms of exposure amount: a decrease of the speed figures with 0.30 log units is equivalent with a speed increase with a factor of 2);

the contrast, calculated between the densities 0.25 and 2.0 above fog.

As can be seen from the Table 2, the sensitometric properties are matching very well with those required in DEV1. In the developer DEV3 according to this invention, a shorter development time (DT) is required. As can be derived from these experiments the covering power, defined as the ratio of the maximum density and the amount in grams of developed silver, is maintained in DEV3 versus in the normal developers (DEV1, respectively DEV2), with a trend to give an enhanced value for the cubic AgCl emulsion. This trend is fully in accordance with the invention disclosed in EP-A 0 678 772.

TABLE 2

| Developer | Film | AgX | DT | Fog F | Speed S | Contrast | Dmax |
|---|---|---|---|---|---|---|---|
| DEV1 (comp.) | A | AgBr | 22" | 0.04 | 1.67 | 2.85 | 3.40 |
| DEV2 (comp.) | B | AgCl | 22" | 0.04 | 1.68 | 3.00 | 3.40 |
| DEV3 (invention) | A | AgBr | 22" | 0.05 | 1.49 | 3.03 | 3.49 |
| | B | AgCl | 15" | 0.05 | 1.68 | 3.20 | 3.62 |
| DEV4 (invention) | A | AgBr | 22" | 0.05 | 1.50 | 2.95 | 3.44 |
| | B | AgCl | 15" | 0.05 | 1.68 | 3.05 | 3.65 |

From table 2, it is clear that in the developers DEV3 and DEV4, according to this invention, a shorter development time is required to get the same sensitometry, which is in favour of rapid processing applications.

Antioxidation Test

This test was performed as follows.

100 ml of developer was brought into contact with air oxygen after said developer was poured into a plastic bottle of 250 ml. Table 3 indicates the number of days after which the colour of the developer turns brown. This time interval gives an indication how long it takes before all of the antioxidation products in the developer are exhausted. As a consequence hydrochinon is oxidised completely to chinon, which explains the changement of the colour of the developer.

Moreover sensitometric results (fog, speed and maximum density) are given after development for 22 seconds in DEV1 (for Film A, 99% AgBr) and for 15 seconds in DEV3 or its variants (for Film B, 99.7% AgCl) in fresh developer solutions.

TABLE 3

| Developer | Film | AgX | Fog F | Speed S | Dmax | No. days |
|---|---|---|---|---|---|---|
| DEV1 (comp.) | A | AgBr | 0.04 | 1.67 | 3.40 | 13 |
| DEV3 (inv.) | B | AgCl | 0.07 | 1.69 | 3.57 | 22 |
| DEV4 (inv.) | B | AgCl | 0.05 | 1.70 | 3.54 | **** |

****no brown colour as no hydroquinone is present

It can be concluded that ascorbic acid in the developer according to this invention, as for DEV3 and DEV4, not only gives rise to a more stable developer against air oxidation but that it also provides improved sludge behaviour.

After 10 days of oxidation by air oxygen of a solution of 100 ml and addition of 100 ml of demineralised water the sensitometry obtained for film A in DEV1 and film B in the developers DEV3 and DEV4 is summarised in Table 4.

TABLE 4

| Developer | Film | AgX | Fog F | Speed S | Dmax |
|---|---|---|---|---|---|
| DEV1 (comp.) | A | AgBr | 0.04 | 1.72 | 3.30 |
| DEV3 (inv.) | B | AgCl | 0.04 | 1.72 | 3.78 |
| DEV4 (inv.) | B | AgCl | 0.02 | 1.72 | 3.40 |

For the developers DEV3 and DEV4 loss in sensitivity for film B seems to be less than for film A in DEV1.

Example 2

In this Example a comparison is given of the silver deposit obtained with Material C (SPR712p, trademarked product from Agfa-Gevaert, having an emulsion rich in chloride: 83.6 mole % of chloride, 16 mole % of bromide and 0.4 mole % of iodide).

The development was carried out in DEV5 (=G101, a typical standard developer for graphic materials) and modifications thereof, resulting in a developer according to this invention. Method B was applied in order to determine the amount of silver deposit quantitatively. Results thereof are summarised in Table 5.

TABLE 5

| Developer | Silver deposit in exhausted developer (in mg/l) |
|---|---|
| DEV5 (comp.) | 15.7 |
| DEV6 (inv.) | 6.0 |
| DEV7 (inv.) | 3.6 |

As can be concluded from Table 5, the reduction of sulphite ions and the presence of ascorbic acid reduces the amount of silver deposit with 60%, whereas the use of sodium salts instead of potassium salts makes the reduction of silver deposit increase with about 40%.

A sensitometric evaluation of SPR712P (also a trademarked product from Agfa-Gevaert, having an emulsion rich in chloride: 83.6 mole % of chloride, 16 mole % of bromide and 0.4 mole % of iodide) is given in Table 6 wherein the effect of DEV6 and DEV7 is shown.

The speed values defined as log exposure values at an optical density of 3.00 above fog were expressed as logarithmic values. GRD1 represents the "toe" gradation, whereas GRD2 represents the rectilineal gradation.

TABLE 6

| Developer | Fog F | Speed S | GRD1 | GRD2 | DMAX |
|---|---|---|---|---|---|
| DEV5 (comp.) | 0.03 | 1.47 | 2.46 | 9.77 | 5.72 |
| DEV6 (inv.) | 0.04 | 1.45 | 2.34 | 10.35 | 5.76 |
| DEV7 (inv.) | 0.04 | 1.49 | 2.29 | 9.73 | 5.65 |

As can be seen from Table 6 the sensitometry obtained after development in DEV6 and DEV7 matches very well with the comparative in DEV5.

What is claimed is:

1. Photographic developing solution having a pH value between 9.6 and 11.0, comprising hydroquinone in an amount from 0 to less than 30 g per liter, an auxiliary developing agent, and as silver halide complexing agents alkali metal sulphite salts in an amount from 0 to less than 50 g per liter, thiocyanate salts in amounts from 0.1 to 3 g, and of a compound corresponding to the formula (I), a precursor thereof, and/or a metal salt thereof (I)

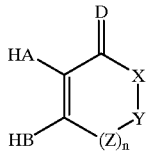

wherein each of A, B and D independently represents an oxygen atom or $NR^1$;

X represents an oxygen atom, a sulphur atom, $NR^2$; $CR^3R^4$; C=O; $C{=}NR^5$ or C=S;

Y represents an oxygen atom, a sulphur atom, $NR'^2$; $CR'^3R'^4$; C=O; $C{=}NR'^5$ or C=S;

Z represents an oxygen atom, a sulphur atom, $NR''^2$; $CR''^3R''^4$; C=O; $C{=}NR''^5$ or C=S;

n equals 0, 1 or 2;

each of $R^1$ to $R^5$, $R'^1$ to $R'^5$ and $R''^1$ to $R''^5$, independently represents hydrogen, alkyl, aralkyl, hydroxyalkyl, carboxyalkyl; alkenyl, alkynyl, cycloalkyl, cycloalkenyl, aryl or heterocyclyl; and wherein $R^3$ and $R^4$, $R'^3$ and $R'^4$, $R''^3$ and $R''^4$, may further form together a ring; and wherein in the case that $X{=}CR^3R^4$ and $Y{=}CR'^3R'^4$, $R^3$ and $R'^3$ and/or $R^4$ and $R'^4$ may form a ring and wherein in the case that $Y{=}CR'^3R'^4$ and $Z{=}CR''^3R''^4$ with n=1 or 2, $R'^3$ and $R''^3$ and/or $R'^4$ and $R''^4$ may form a ring.

2. Photographic developing solution according to claim 1, wherein in the formula (I) A, B and X each represent an oxygen atom; n=0; $Y{=}CH{-}(CHOH)_m{-}CH_2{-}R^6$ wherein m=1, 2, 3 or 4 and wherein $R^6$ represents OH for m=1; H or OH for m=2, 3 or 4.

3. Photographic developing solution according to claim 1, wherein in the formula (I) A and B each represent an oxygen atom; n=0 and each of X and Y represents $C(CH_3)_2$.

4. Photographic developing solution according to claim 1, wherein said solution has a pH value between 9.6 and 10.3.

5. Photographic developing solution according to claim 1, wherein the said alkali metal sulphite salts are present in an amount of less than 40 g per liter.

6. Photographic developing solution according to claim 1, wherein thiocyanate salts are present in an amount of from 0.5 to 2.5 g per liter.

7. Photographic developing solution according to claim 1, wherein said compound corresponding to the formula (I) is present in an amount between 1 g and 50 g per liter.

8. Photographic developing solution according to claim 1, wherein the amount of hydroquinone is less than 20 g per liter.

9. Photographic developing solution according to claim 1, wherein said auxiliary developer represents at least one 1-phenyl-3-pyrazolidine-1-one developing agent in a concentration ranging up to 10 mmoles per liter.

10. Photographic developing solution according to claim 1, wherein said alkali metal sulphite salt is a sodium sulphite.

11. Method for developing an image-wise exposed silver halide photographic material, comprising the steps of immersing said material in a photographic developing solution according to claim 1.

12. Method according to claim 11, wherein the concentration of said compound according to formula (I) and the pH is maintained at a constant value by replenishment with unoxidized developing agent, thereby adding a concentrated alkali metal hydroxide solution under controlled constant redox potential.

13. Method according to claim 11, wherein the replenishment is carried out in amounts from 50 to 250 ml/$m^2$ of photographic material.

14. Method according to claim 11, wherein the replenishment is carried out in amounts from 50 to 150 ml/$m^2$ of photographic material.

15. Method according to claim 11, wherein the development proceeds in an automatic processor in a time between 5 and 45 seconds at a temperature between 25 and 40° C.

* * * * *